US005441127A

United States Patent [19]

Ikejima et al.

[11] Patent Number: 5,441,127

[45] Date of Patent: Aug. 15, 1995

[54] ELEVATOR CONTROL APPARATUS

[75] Inventors: Hiroyuki Ikejima; Sigemi Iwata; Masayuki Yosida, all of Inazawa, Japan

[73] Assignee: Mitsubishi Denki Kabushiki Kaisha, Tokyo, Japan

[21] Appl. No.: 155,907

[22] Filed: Nov. 23, 1993

Related U.S. Application Data

[63] Continuation of Ser. No. 712,523, Jun. 10, 1991, abandoned.

[30] Foreign Application Priority Data

Jun. 11, 1990 [JP] Japan ..... 2-149841
Mar. 4, 1991 [JP] Japan ..... 3-37395

[51] Int. Cl.[6] ..... B66B 1/44
[52] U.S. Cl. ..... 187/292; 187/393
[58] Field of Search ..... 187/115, 116, 118, 119, 187/131, 130, 117, 132, 292, 293, 295, 296, 391, 392, 393

[56] References Cited

U.S. PATENT DOCUMENTS 4,738,337 3/1988 Caputo ..... 187/115
4,793,442 12/1988 Heckler et al. ..... 187/115

FOREIGN PATENT DOCUMENTS 0427075 5/1991 European Pat. Off. .
59-163278 9/1984 Japan .
63-117886 5/1988 Japan .
1313285 12/1989 Japan .
1083260 9/1967 United Kingdom .
2055207 2/1981 United Kingdom .

*Primary Examiner*—Steven L. Stephan
*Assistant Examiner*—Robert Nappi
*Attorney, Agent, or Firm*—Leydig, Voit & Mayer

[57] ABSTRACT

An elevator control apparatus comprises a torque command generating device for generating a torque command, a converter device for supplying electric power to a motor for driving an elevator car, a car position calculation device for calculating the present position of the elevator car, a compensation device for calculating an unbalanced rope torque on the sides of the elevator car and a counterweight from the torque command generated by the torque command generating device and the present position of the elevator car calculated by the car position calculation device, a load weighing device for detecting a load in the elevator car, and a final torque command supply device for adding outputs of the compensation device and the load weighing device to the torque command generated by the torque command generating device and supplying the torque command as a final torque command to the converter device. According to the apparatus, since the unbalanced load is compensated and the elevator car is driven according to the compensation, the riding quality of the elevator car is improved.

7 Claims, 7 Drawing Sheets

ELEVATOR CONTROL APPARATUS

This application is a continuation of application Ser. No. 07/712,523, filed Jun. 10, 1991 now abandoned.

BACKGROUND OF THE INVENTION

1. Field of the Invention

This invention relates to an elevator control apparatus, and more particularly, to an apparatus for controlling an elevator by using a load weighing device.

2. Description of the Related Art

In a control apparatus for an elevator, improvements in electronic and electric control devices employed as subsystems have recently been made due to the development of microelectronics and power electronics. Furthermore, the performance of mechanical portions of the elevator has been also improved due to the development of mechanical engineering. For example, a high-efficiency worm gear, a helical gear and the like have been used in a hoist of an elevator in order to promote a further saving of electricity and energy. An elevator using such a hoist has a load weighing device to control with high efficiency loads on the side of an elevator car at the time when the elevator is started, operated and stopped, that is, loads ranging from no load to a rated load.

The first function of this load weighing device is to detect a load in an elevator car, add a torque corresponding to the load to a motor torque previous to the operating of the elevator, improve the riding quality at the time when the elevator car is started, operated and stopped, and improve the landing accuracy. The second function thereof is to control the operation of the elevator car in accordance with the load therein. For example, if too many passengers get into the elevator car the load weighing device informs the passengers and makes the elevator car pass a number of floors at which it usually stops. The number of floors that the elevator passes depends on the percentage of the passengers in the elevator car. The load weighing device also assigns a not-full elevator from a plurality of elevator cars. A load weighing device that causes the elevator car to pass floors at which it normally stops is called a control weighing device.

FIG. 7 shows this kind of conventional elevator control apparatus.

Referring to FIG. 7, the control apparatus is provided with a sheave 11, a rope 12 hung on the sheave 11, a counterweight 13, a car frame 14 connected to the rope 12 through a shackle spring (not shown) at the tip of the rope 12, a cage 15 located in the car frame 14, a rubber vibration insulator 16 supporting the cage 15, a load weighing device 17 disposed parallel to the rubber vibration insulator 16 for outputting a predetermined signal 17*a*, a cable 18, such as a power line or a signal line, for supplying electric power to an elevator car and also transmitting and receiving signals to and from the elevator car, a drive motor 19 for driving the sheave 11, a power converter device 20 for driving the motor 19, a microcomputer 21 at the core of the operation control and administration of the elevator for outputting a torque command 21*a* to the power converter device 20. Numerals 22, 23 and 24 denote the top floor, the center floor in the center of the whole elevation path, and the bottom floor, respectively.

In the control apparatus, the weight of the cage 15 and passengers and loads in the cage 15 are detected by the load weighing device 17. The load-weighing device 17 generally has a plurality of contacts, and when passengers get into the cage 15 the rubber vibration insulator 16 is bent and some of the contacts are turned in accordance with the amount of bending. These plurality of contacts are set to be gradually actuated at, for example, 25%, 50%, 75%, 110% and so on of a rated load, respectively. The signal 17*a* is output from each of the contacts to the microcomputer 21.

The microcomputer 21 functions as the core of the operation control and administration of the elevator and gives instructions regarding the registration, illuminating and extinguishing of the lights of floor buttons and cage buttons. The microcomputer 21 also controls the closing of the door, the starting, operating and stopping of the elevator car, and supplies a proper torque command 21*a* for the operating of the elevator to the power converter device 20 for driving the motor 19.

According to the elevator control apparatus having the above construction, for example, if too many passengers get into the cage 15, the weight Of the cage 15 and the passengers exceeds the rated load, a 110% contact of the load weighing device 17 is turned on, and then a signal 17*a* is output from the contact to the microcomputer 21. The microcomputer 21 informs the passengers that there are too many passengers by a buzzer or the like, and gives a command to keep the elevator door open.

In the case of a high-efficiency hoist, an unbalanced torque of a sheave shaft causes riding quality to become worse. Although the unbalanced torque of the sheave shaft includes the unbalanced rope weight on the sides of the elevator car and the counterweight and a torque corresponding to the weight of the cable 18 in addition to a torque corresponding to the load in the elevator car, the conventional load weighing device 17 cannot detect the unbalanced rope weight, the weight of the cable 18 and so on. The cable 18 contains power lines and signal lines which are connected to the elevator car and are heavy. Therefore, it is impossible to precisely compensate the unbalanced torque of the sheave shaft based on only the output of the load weighing device 17. As a result, the weight of the rope 12 and the cable 18 is not compensated when the elevator car starts to move, and a sufficient riding quality is not obtained. Furthermore, it is difficult to obtain a sufficient riding quality as regards the landing of the elevator car and the landing accuracy for the same reason as given above.

SUMMARY OF THE INVENTION

Accordingly, an object of this invention is to provide an elevator control apparatus capable of improving riding quality.

In order to achieve the above object, according to one aspect of the present invention, there is provided an elevator control apparatus which comprises a torque command generating means for generating a torque command, a converter means for supplying electric power to a motor for driving an elevator car, a car position calculation means for calculating the present position of the elevator car, a compensation means for calculating unbalanced rope torque on the sides of the elevator car and a counterweight from the torque command generated by the torque command generating means and the present position of the elevator car calculated by the car position calculation means, a load weighing means for detecting a load in the elevator car, and a final torque command supply means for adding outputs of the compensation means and the load weighing means to the torque command generated by the torque command generating means and supplying the torque command as a final torque command to the converter means.

DESCRIPTION OF THE PREFERRED EMBODIMENTS

Figure 1:
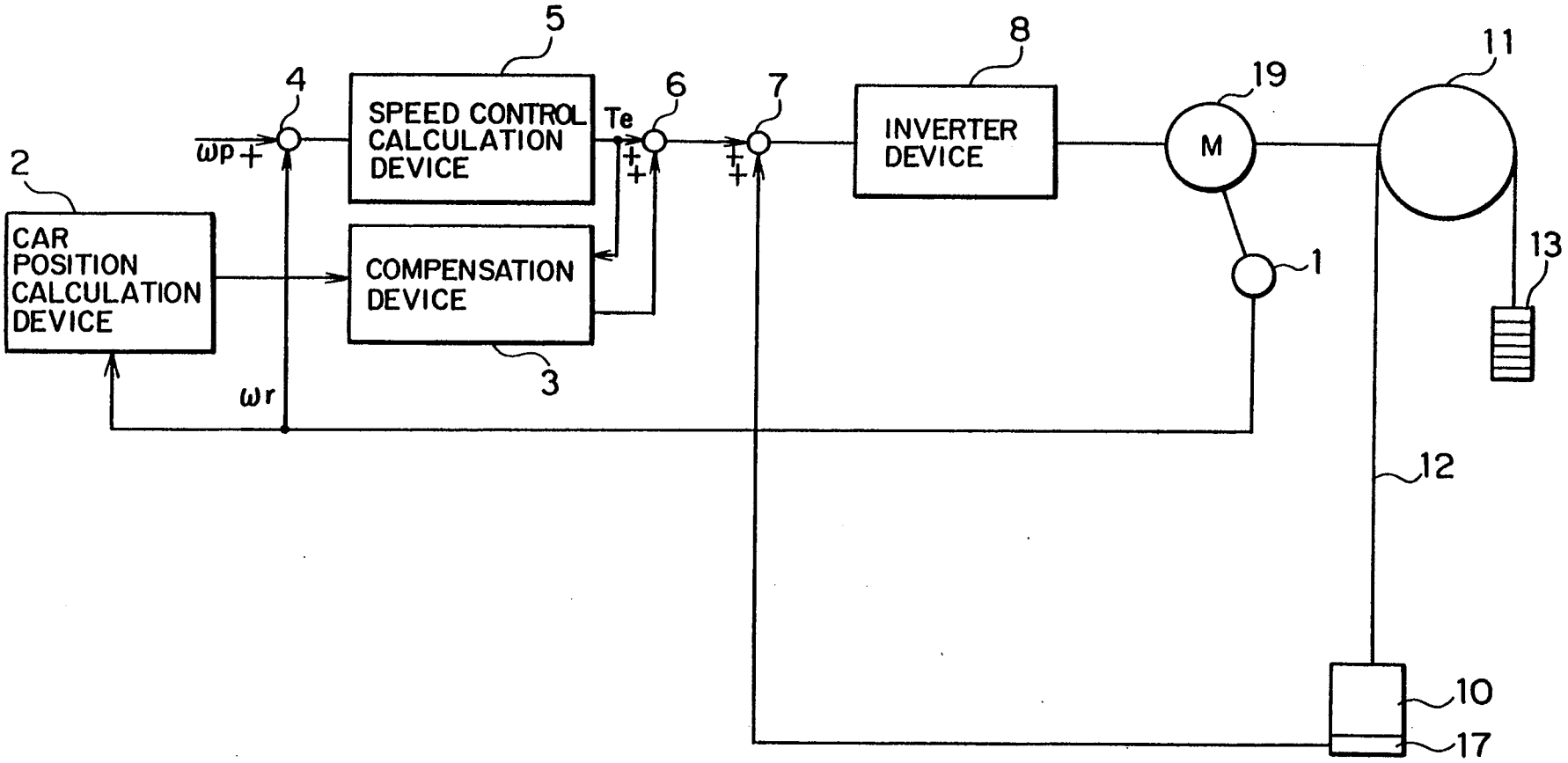
FIG. 1 is a block diagram of an elevator control apparatus according to a first embodiment of this invention.

Referring to FIG. 1, a rope 12 is hung on a sheave 11. One end of the rope 12 is connected to an elevator car 10 of an elevator and the other end thereof is connected to a counterweight 13. A load weighing device 17 for detecting a load in the elevator car 10 is disposed at the bottom of the elevator car 10. A motor 19 is connected to the sheave 11 so as to drive the sheave 11 and a speed detector 1 for detecting the rotational speed of the motor 19 is connected to the motor 19. A car position calculation device 2 is connected to the speed detector 1, and a compensation device 3 is connected to the car position calculation device 2. A speed control calculation device 5 is connected to the speed detector 1 through a subtracter 4, and outputs of the compensation device 3 and the speed control calculation device 5 are connected to a first adder 6. Outputs of the first adder 6 and the load weighing device 17 are connected to an inverter device 8, which drives and controls the motor 19, through a second adder 7. A speed command $\omega_p$ generated by an unillustrated speed command generating device is input to the subtracter 4.

The operation of the first embodiment will now be described. The speed detector 1 detects the rotational speed of the motor 19 and outputs a speed signal $\omega_r$ to the subtracter 4. The subtracter 4 subtracts the speed signal $\omega_r$ from the speed command $\omega_p$ output from the speed command generating device, and the speed control calculation device 5 generates a torque command Te based on the output of the subtracter 4. The speed signal $\omega_r$ from the speed detector 1 is also input to the car position calculation device 2 so as to calculate the present position (the distance from the bottom floor) of the elevator car 10. The compensation device 3 calculates an unbalanced torque related to the rope 12 based on the present position-of the elevator car 10 calculated by the car position calculation device 2 and the torque command Te generated by the speed control calculation device 5.

Subsequently, the unbalanced torque from the compensation device 3 is added to the torque command $T_e$ from the speed control calculation device 5 in the first adder 6, and furthermore, the output of the load weighing device 17, that is, the load in the elevator car 10 is added in the second adder 7 and output to the inverter device 8 as a final torque command. The inverter device 8 controls the drive of the motor 19 according to the final torque command.

Figure 2:
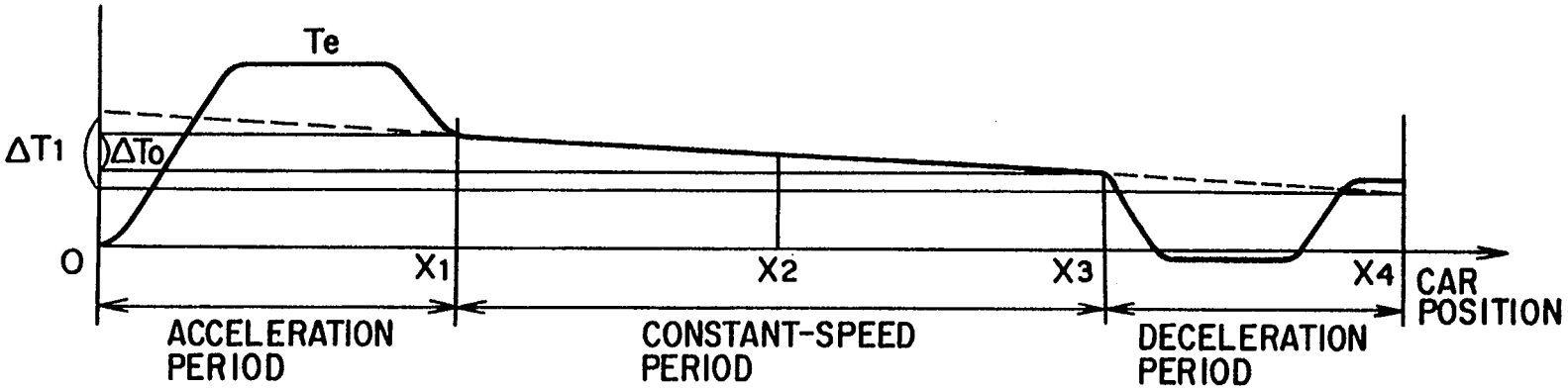
FIG. 2 is a view showing the operation of the first embodiment.

For example, if the elevator car 10 in which a rated load is laid as a load-in-car runs from the bottom floor and the top floor, a torque command Te is output from the speed control calculation device 5 as shown in FIG. 2. Referring to FIG. 2, the horizontal axis indicates the position of the elevator car 10, that is, the distance from the bottom floor, and $X_1$, $X_2$, $X_3$, and $X_4$ designate the position of the elevator car 10 when acceleration of the elevator car 10 is completed, the position where the elevator car 10 and the counterweight 13 pass each other, the position of the elevator car 10 when deceleration is started after a constant-speed run, and the position of the top floor.

As for the constant-speed run, the torque at the position $X_1$ is an unbalanced torque arising from the weight obtained by adding the unbalanced weight of the rope 12 to the difference in weight between the elevator car 10 and the counterweight 13. At this time, the unbalanced weight of the rope 12 is a value (>0) obtained by subtracting the rope weight on the side of the counterweight 13 from the rope weight on the side of the elevator car 10 with respect to the sheave 11. On the contrary, the torque at the position $X_3$ is smaller than that at the position $X_1$ since the unbalanced weight of the rope 12 is negative. At the center position $X_2$, since the unbalanced weight of the rope 12 is 0, the torque at this time is equal to the unbalanced torque arising from the difference in weight between the elevator car 10 and the counterweight 13, and corresponds to the output from the load weighing device 17.

If it is assumed that a difference in torque between the positions $X_1$ and $X_3$ is $\Delta T_0$, the torque difference $\Delta T_1$ between the top position and the bottom position due to the rope unbalance indicated by a broken line shown in FIG. 2 is as follows:

$$\Delta T_1 \cdot X_4/(X_3 - X_1) \tag{1}$$

Therefore, the load unbalanced torque T when the elevator car 10 is at an arbitrary position X is as follows:

$$\begin{aligned} T &= T_2 + \Delta T_1(X_2 - X)/2X_2 \\ &= T_2 + \Delta T_1(X_2 - X)/X_4 \end{aligned} \tag{2}$$

$T_2$ designates a torque at the position $X_2$. The first term of the expression (2) corresponds to an output value of the load weighing device 17 and the second term corresponds to a compensation value for the rope unbalance. The compensation device 3 calculates the compensation value in the second term.

The compensation method by the compensation device 3 will now be described. The elevator generally carries out a floor height writing operation in installation or maintenance thereof. In this operation, the car position calculation device 2 measures and stores the distance at which the elevator car moves from the bottom floor each time detection switches (not shown) mounted on all of the floors each are actuated during the run of the elevator from the bottom floor to the top floor.

In the floor height writing operation, the compensation device 3 executes the following steps:

i) storing the position $X_1$ and the torque command Te when the speed of the elevator becomes constant;

ii) storing the position $X_3$ and the torque command Te when the speed of the elevator starts to be reduced;

iii) calculating the center position $X_2$ based on the position $X_4$ of the top floor; and iv) calculating $\Delta T_1$ according to the expression (1).

In a normal running operation, the second term of the expression (2) is found based on $\Delta T_1$ calculated in the above step iv) and the present position X of the elevator car 10 which is always calculated in the car position calculation device 2. The load unbalanced torque T is calculated by adding the output of the load weighing device 17 as the first term, and output to the inverter device 8.

Since the load unbalance is thus compensated, the riding quality of the elevator is improved.

Figure 3:
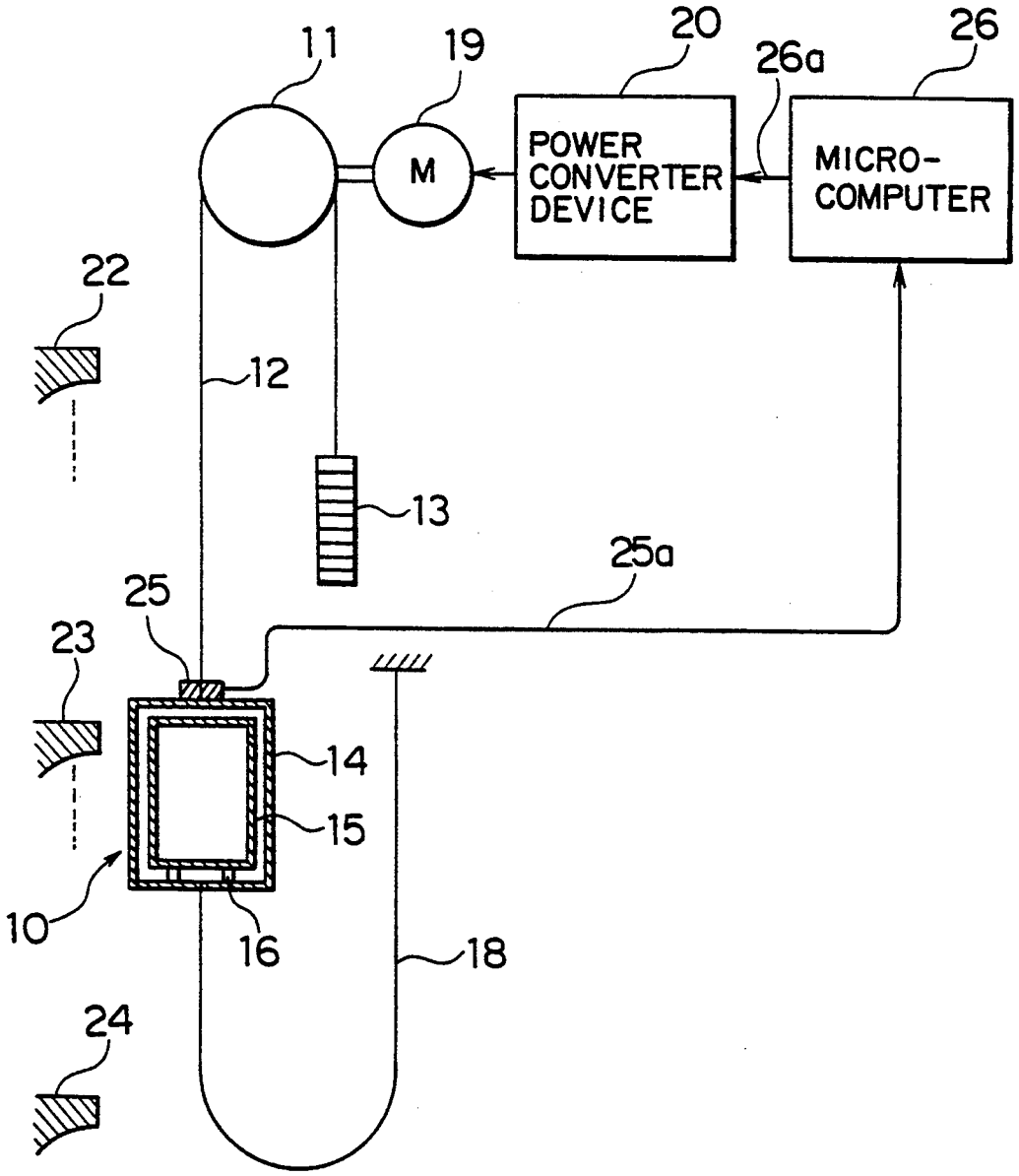
FIG. 3 is a block diagram showing the overall construction of a second embodiment.

A second embodiment of this invention is shown in Fig. 3. A rope 12 is hung on a sheave 11. One end of the rope 12 is connected to a counterweight 13 and the other end thereof is connected to an elevator car 10 of the elevator. The elevator car 10 is provided with a car frame 14, a cage 15 located in the car frame 14 and a rubber vibration insulator 16 supporting the cage 15. A cable 18 supplies electric power to the elevator car 10 and transmits and receives signals to and from the elevator car 10. A motor 19 is connected to the sheave 11 so as to drive the sheave 11, and a microcomputer 26 is connected to the motor 19 through a power conversion device 20. Numerals 22, 23 and 24 denote the top floor, an intermediate floor and the bottom floor, respectively.

Figure 7:
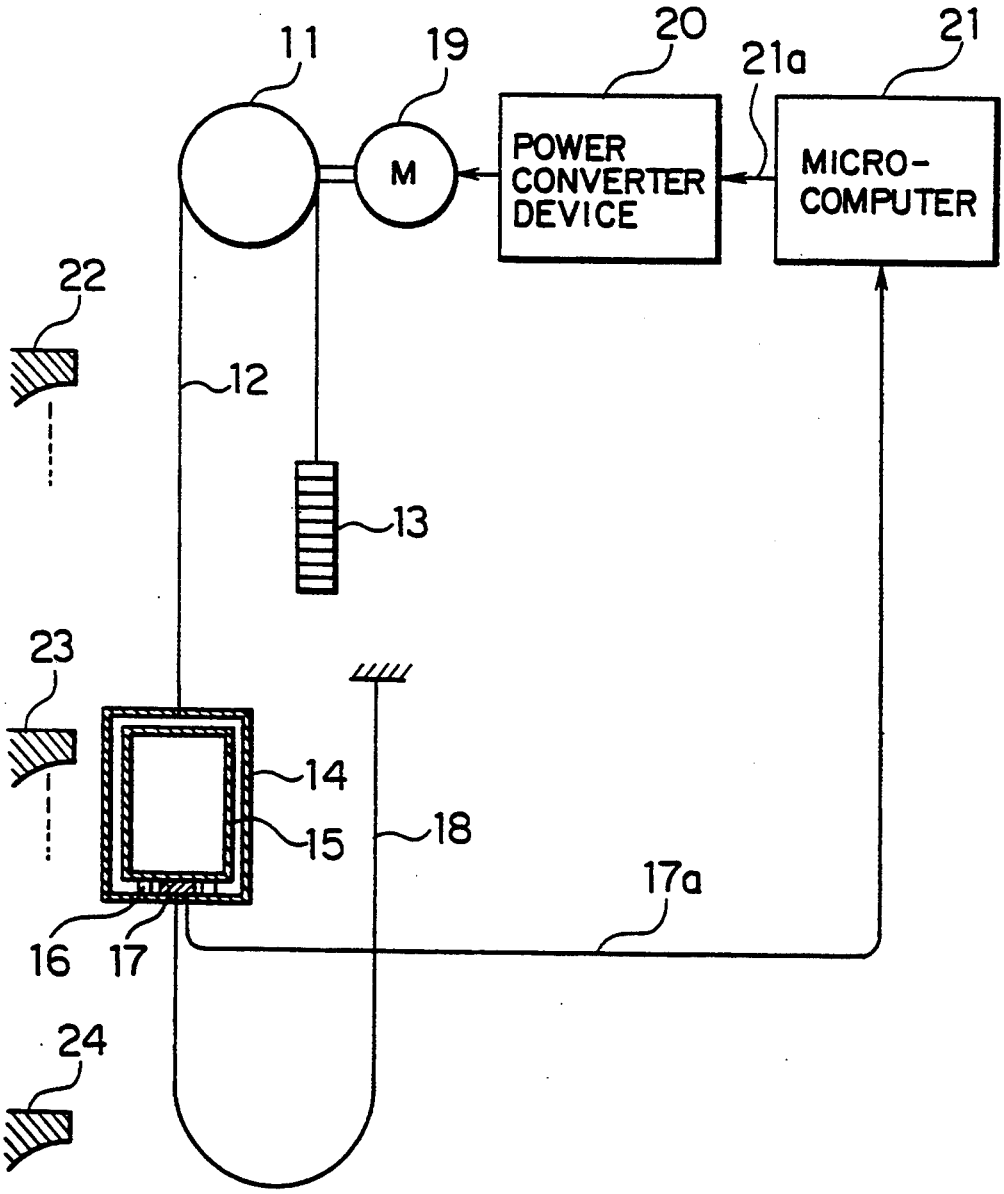
FIG. 7(PRIOR ART)
FIG. 7 is a block diagram of a conventional elevator control apparatus.

In other words, the second embodiment is different from the conventional control device shown in FIG. 7 in that a load weighing device 25 is mounted on the top of the car frame 14 instead of the load weighing device 17 and that the microcomputer 26 is utilized instead of the microcomputer 21. The load weighing device 25 measures the total weight of the elevator car 10, the passengers in the cage 15 and the cable 18, and outputs the measured value to the microcomputer 26 by an analog signal 25*a*.

Figure 4:
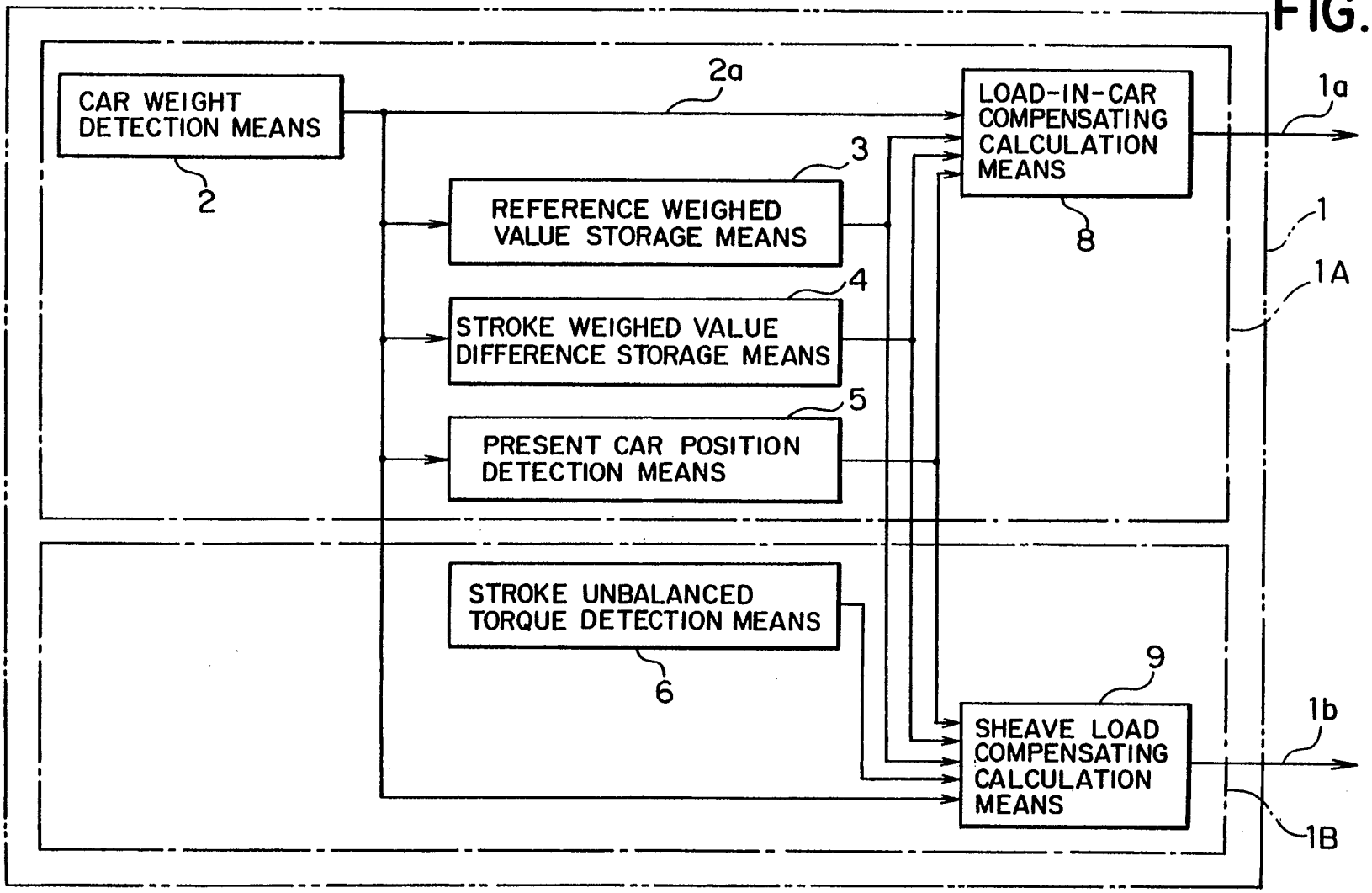
FIG. 4 is a functional block diagram of the second embodiment.

FIG. 4 is a functional block diagram of the second embodiment.

Referring to FIG. 4, a load detection means 1 is composed of a load-in-car detection means 1A and a sheave load detection means 1B. Numerals 1*a* land 1*b* denote a control weight signal as an output of the load-in-car detection means 1A and a drive weight signal as an output of the sheave load detection means 1B, respectively. A car weight detection means 2 for detecting the weight of the elevator car corresponds to the load weighing device 25. A reference weighed value storage means 3 determines and stores the zero point and gain of the car weight detection means 2. A stroke weighed value difference storage means 4 detects and stores a difference in value of the output from the car weight detection means 2 between the top floor and the bottom floor in an elevation stroke of the elevator car. A present car position detection means 5 detects the present position of the elevator car. A stroke unbalanced torque detection means 6 detects and stores a difference in value of the torque command 26*a* of the motor 19 between the top floor and the bottom floor in the elevation stroke of the elevator car. A load-in-car compensating calculation means 8 makes compensation so as to output a control weight signal 1*a* (a signal for detecting the load in the elevator car). A sheave load compensating calculation means makes compensation so as to output a drive weight signal (a signal for detecting the unbalanced weight with respect to the sheave 11).

Figure 5:
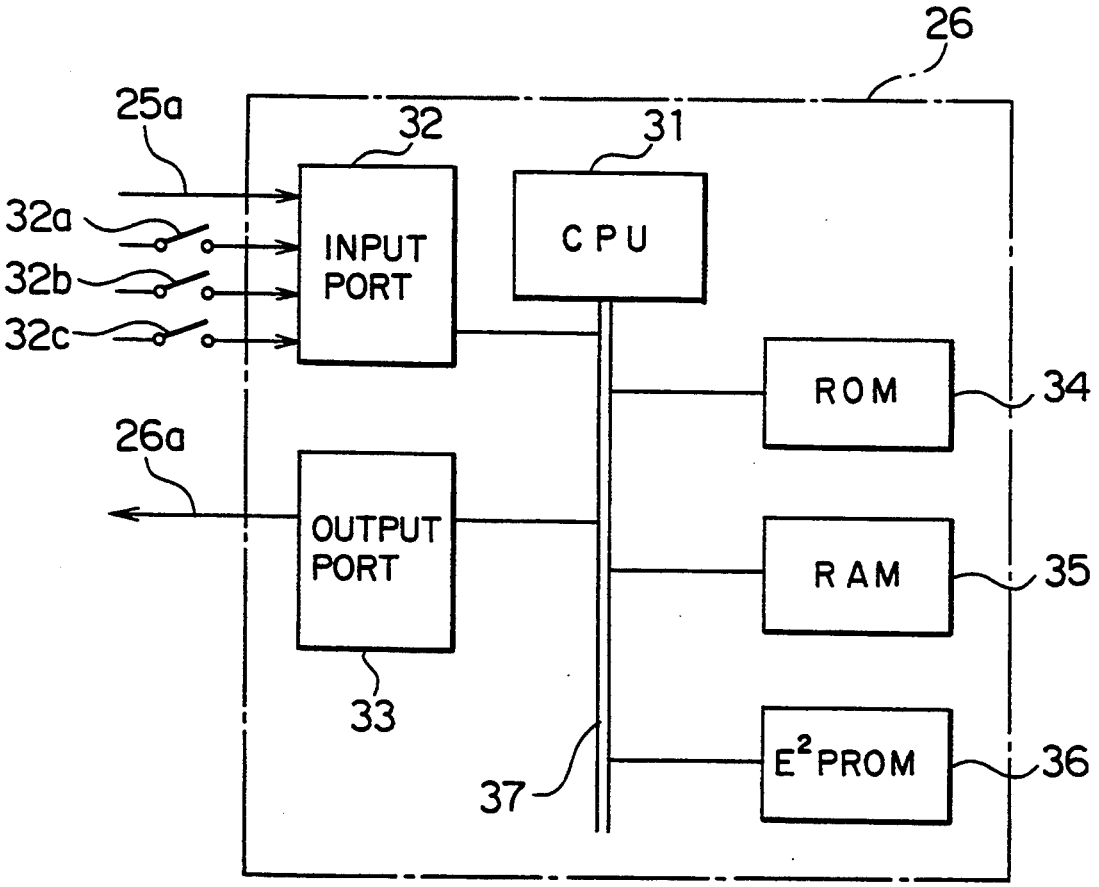
FIG. 5 is a block diagram of a microcomputer used in the second embodiment.

The microcomputer 26 has the construction shown in FIG. 5, and comprises a central processing unit (CPU) 31, an input port 32, an output port 33, a read-only memory (ROM) 34, a readable and writable memory (RAM) 35, a nonvolatile memory ($E^2$PROM) 36 writable and erasable by electric signals, and a bus 37 as an information transmission path inside the microcomputer 26. Numerals 32*a*, 32*b* and 32*c* denote a switch to write a weighed value when there is no load in the elevator car into the $E^2$PROM 36, a switch to write a weighed value when there is balanced load in the elevator car into the $E^2$PROM 36, and a switch for the floor height writing operation to make the elevator measure the heights of the floors. The signal 25*a* of the load weighing device 25 is an analog signal, converted from analog to digital by the input port 32, and stored in the RAM 35 or the $E^2$PROM 36 in response to a command from the CPU 31.

The elevator control apparatus in this embodiment is constructed as described above, and detects a load in the elevator car (control weighed value) and the sheave load (drive weighed value). The control weighed value K (Zn, $\alpha$) can be calculated according to an expression (3) in the following paragraph regarding the detection of the control weighed value, and the drive weighed value S (Zn, $\alpha$) can be also calculated according to an expression (4) (when the car is at a stop) or an expression (5) (when the car is running) in the following paragraph regarding the detection of the drive weighed value. Zn designates the position of the elevator car and $\alpha$ shows that the load rate in the elevator car.

The principle of weight detection will be described.

First, the case of a one-to-one roping elevator shown in FIG. 3 will be explained. The following conditions are set in this case:

Wcar . . . the self-weight of the elevator car 10 (the total weight of the car frame 14 and the cage 15)

L . . . a rated load

Z . . . the position of the elevator car 10 measured from the bottom floor 24 wc (Z) . . . the weight of the cable detected by the load weighing device 25

$\epsilon$ . . . the unbalanced weight of the cable included in the counterweight 13 wr (Z) . . . the weight of a rope and a cable detected by the motor 19 (only the unbalanced weight with respect to the motor shaft)

V (Z, $\gamma$) . . . a weighed value when the position of the elevator car is Z and the load factor is $\gamma$ ($\gamma$=the load in the car/the rated load L)

ZB . . . a constant showing that the elevator car is located at the bottom floor 24

ZC . . . a constant showing that the elevator car is located at the center floor 23

ZT . . . a constant showing that the elevator car is located at the top floor 22 wc(Z) and wr(Z) are linear with respect to the car position Z.

The following values are set at the installation of the elevator.

At the installation and maintenance of the elevator, the adjuster puts NL (no load in the elevator car) and BL (balanced load in the elevator car) into the car and stops the elevator car at the center floor 23 in the elevation path. When the switches 32*a* and 32*b* shown in FIG. 5 are pressed, weighed output values are automatically written in the E²PROM 36 as follows:

V(ZC, 0)=Wcar+wc(ZC) . . . a weighed value when the elevator car is located at the center floor 23 and the load is 0

V(ZC, β)=Wcar+βL+wc(ZC) . . . a weighed value when the elevator car is located at the center floor 23 and the load is BL β designates the counterweight rate.

The values of V(ZC, 0) and V(ZC, β) are stored in the E²PROM 36 as reference weighed values.

The detection of the control weight will be described. As described above, the control weighing is a function of measuring only the load in the elevator car, that is, the weight of passengers in the elevator car.

Values to be detected previous to the operation of the elevator car are subsidiarily measured in the floor height writing operation. This measurement is performed when the elevator car stops at the top floor 22 and the bottom floor 24.

Weighed values at the bottom floor 24 and the top floor when the load is γL are as follows:

$$V(ZB, \gamma)=Wcar+\gamma L+wc(ZB)$$

$$V(ZT, \gamma)=Wcar+\gamma L+wc(ZT)$$

Therefore, a stroke weighed value difference value is as follows:

$$\begin{aligned} V(ZT, \gamma) - V(ZB, \gamma) &= wc(ZT) - wc(ZB) \\ &= C \text{ (a constant)} \end{aligned}$$

This stroke weighed value difference value may be measured by using an arbitrary load.

If it is assumed that a load αL is laid in the elevator car on the n-th floor, a weighed value at this time is as follows:

$$V(Zn, \alpha)=Wcar+\alpha L+wc(Zn)$$

If a control weighed value αL to be detected is K(α), $$\begin{aligned} K(\alpha) = \alpha L &= V(Zn, \alpha) - Wcar - wc(Zn) \\ &= V(Zn, \alpha) - [Wcar + wc(ZC)] - \\ &\quad [wc(Zn) - wc(ZC)] \end{aligned}$$

A weighed value corresponding to Wcar+wc(ZC) in this expression is V(ZC, 0), and wc(Zn)−wc(ZC) is a linear expression related to Zn. In other words, since $$wc(Zn)=\{C/(ZT-ZB)\}\times(Zn-Zc)+wc(ZC),$$

$$wc(Zn)-wc(ZC)=\{C/(ZT-ZB)\}\times(Zn-Zc).$$

Therefore, $$K(Zn, \alpha) = V(Zn, \alpha) - V(ZC, 0) - \{C/(ZT - ZB)\} \times (Zn - ZC) \quad (3)$$

V(Zn, α) designates a weighed value at the present time, and V(ZC, 0) designates a weighed value when the load is 0 at the center floor 23. {C/(ZT−ZB)}×(Zn−ZC) represents a cable compensation value, which can be found by calculation. Since V(ZC, 0) and C are already written in the E²PROM 36, the calculation is made in the CPU 31 by using the written values.

The detection of drive weighing will now be described. As described above, the drive weighing is a function of detecting the unbalanced weight between the sides of the elevator car and the counterweight with respect to the sheave shaft.

First, values to be detected previous to the operation of the elevator car are subsidiarily measured in the floor height writing operation. This measurement is carried out while the elevator car is running near the top floor 22 and the bottom floor 24. These values are related to the unbalanced weight with respect to the motor shaft of the ropes and cables.

Values of the motor torque commands TM at the bottom floor 24 and the top floor 22 while the elevator car is running at a constant speed with a certain load γL are as follows:

$$TM(ZB, \gamma)=[\{(\gamma-\beta)L+wr(ZB)-\epsilon\}/\eta]+wlos$$

$$TM(ZT, \gamma)=[\{(\gamma-\beta)L+wr(ZT)-\epsilon\}/\eta]+wlos$$

The weight on the side of the elevator car=Wcar+γL, the weight on the side of the counterweight=Wcar+βL+ε. η and wlos designate efficiency and the running loss, respectively. The load rate γ=the weight of passengers in the elevator car/a rated load (L). For example, since the load rate of 0.5 shows that the weight of the passengers riding in the elevator car corresponds to the half of the rated load, this γL represents the weight of passengers in the elevator car.

Therefore, a stroke torque difference value is $$\begin{aligned} TM(ZT, \gamma) - TM(ZB, \gamma) &= \{wr(ZT) - wr(ZB)\}/\eta \\ &= R \text{ (a constant)} \end{aligned}$$

and constant regardless of the load in the elevator car.

If it is assumed that a load of αL is laid in the elevator car at the n-th floor, a weighed value is as follows:

$$\begin{aligned} V(Zn, \alpha) &= Wcar + \alpha L + wc(Zn) \\ &= [Wcar + \beta L + wc(ZC)] + \\ &\quad [(\alpha - \beta)L + wr(Zn) - \epsilon] + \\ &\quad [wc(Zn) - wc(ZC)] - [wr(Zn) - \epsilon] \end{aligned}$$

$$Wcar + \beta L + wc(ZC) = V(ZC, \beta).$$

On the first assumption, the efficiency η=1 and the running loss wlos=0.

Furthermore, if a drive weighed value is S(Zn, α), since S(Zn, α)=(α−β)L+wr(Zn)−ε, $$S(Zn, \alpha)=V(Zn, \alpha)-V(ZC, \beta)-[wc(Zn)-wc(ZC)]+[wr(Zn)-\epsilon]$$

wc(Zn)−wc(ZC) in this expression is a linear expression related to Zn and, as described above, $$wc(Zn)-wc(ZC)=\{C/(ZT-ZB)\}\times(Zn-Zc)$$

Furthermore, wr(Zn)−ε is also a linear expression related to Zn.

On the second assumption, wr(ZC)=ε. In other words, the counterweight 13 is set so that entire balance is kept when the load-in-car is βL and the elevator car is located at the center floor 23. At this time, S(ZC, $\beta)=0$ and the motor 19 cannot actually detect wr(Zn), but wr(Zn)$-\epsilon$. Then, the following expressing is concluded.

$$\omega_r(Z_n)-\Sigma=\{R/(ZB)\}\times(Z_n-ZC)$$

Therefore, $$S(Zn, \alpha)=V(Zn, \alpha)-V(ZC, \beta)-\{C/(ZT-ZB)\times(Zn-ZC)\}+\{R/(ZT-ZB)\}\times(Zn-ZC) \quad (4)$$

V(Zn, $\alpha$) designates a weighed value at the present time and V(ZC, $\beta$) designates a weighed value when the elevator car is located at the center floor 23 and the load is $\beta$L. {C/(ZT−ZB)}×(Zn−ZC) represents an unbalanced weight of the cable 18 and the {R/(ZT−ZB)}×(Zn−ZC) represents an unbalanced weight of the rope 12 and the cable 18.

Then, the drive weighed value while the elevator car is running will now be described.

The drive weighed value is also used during the operation of the elevator car (to compensate the landing).

It is assumed that the elevator car has started to move from the n-th floor with a load-in-car of $\alpha$L and is running through the s-th floor.

In this case, a weighed value when the elevator car stops at the n-th floor is as follows:

$$V(Zn, \alpha)=Wcar+\alpha L+wc(Zn).$$

If the elevator car stops at the s-th floor, $$V(Zs, \alpha)=Wcar+\alpha L+wc(Zs).$$

Therefore, $$\begin{aligned} V(Zs, \alpha)-V(Zn, \alpha) &= wc(Zs)-wc(Zn) \\ &= \{C/(ZT-ZB)\}\times(Zs-Zn) \end{aligned}$$

and V(Zs, $\alpha$)=V(Zn, $\alpha$)+{C/(ZT−ZB)}×(Zs−Zn)

A drive weighed value when the elevator car has started from the n-th floor and is running through the s-th floor is:

$$\begin{aligned} S(Zs, \alpha) &= V(Zs, \alpha)-V(ZC, \beta)-\{C/(ZT-ZB)\}\times(Zs-ZC)+(ZT-ZB)\}\{R\ (Zs-ZC) \\ &= V(Zn, \alpha)+\{C/(ZT-ZB)\}\times(Zs-Zn)-V(ZC, \beta)-\{C/(ZT-ZB)\}\times(Zs-ZC)+\{R/(ZT-ZB)\times(Zs-ZC) \end{aligned}$$

Therefore, $$S(Zs, \alpha)=V(Zn, \alpha)-V(ZC, \beta)-\{C/(ZT-ZB)\}\times(Zn-ZC)+\{R/(ZT-ZB)\}\times(-Zs-ZC) \quad (5)$$

V(Zn, $\alpha$) designates a weighed value at the time of start (when the elevator car is at a stop), and V(ZC, $\beta$) designates a weighed value when the elevator car is located at the center floor 23 and the load is $\beta$L. Furthermore, {C/(ZT−ZB)}×(Zn−ZC) represents the unbalanced weight of the cable 18 at the time of start (when the car is at a stop), and {R/(ZT−ZB)}×(Zs−ZC) represents the unbalanced weight of the rope 12 and the cable 18 at the present time.

Thus, the control weighed value K($\alpha$) is found according to the expression (3), and the drive weighed value S(Zn, $\alpha$) is found according to the expression (4) (the elevator car is at a stop) or the expression (5) (the elevator car is running).

The elevator can perform a floor height writing operation to measure the height of floors, and surely stops at the bottom floor 24 and the top floor 22 during the operation. Therefore, when the elevator car stops there, V(ZB, $\gamma$), V(ZT, $\gamma$), TM(ZT, $\gamma$) and TM(ZB, $\gamma$) are stored in the E²PROM 36.

The expressions (3), (4) and (5) are solved by the microcomputer 26 shown in FIG. 5 based on the above principle, thereby finding the control weighed value and the drive weighed value. Furthermore, since V(ZC, 0) and C in the expression (3) and V(ZC, $\beta$), C and R in the expressions (4) and (5) each are values peculiar to the elevator, the values are prevented from being lost when the power of the apparatus is turned off by storing the values in the E²PROM 36 in the microcomputer 26 shown in FIG. 5.

In order to find a control weighed value and a drive weighed value without using the elevator control apparatus in this embodiment, it is necessary for the designer to calculate C and R in the expressions (3), (4) and (5) and write C and R in the ROM 34, the E²PROM 36 and so on when an apparatus is shipped. Since these C and R vary according to elevators, the calculation and writing operation requires much time and labor. On the other hand, since the control weighed value and the drive weighed value can be found by calculation of the microcomputer 26 in this embodiment, that is extremely efficient.

Figure 6A:
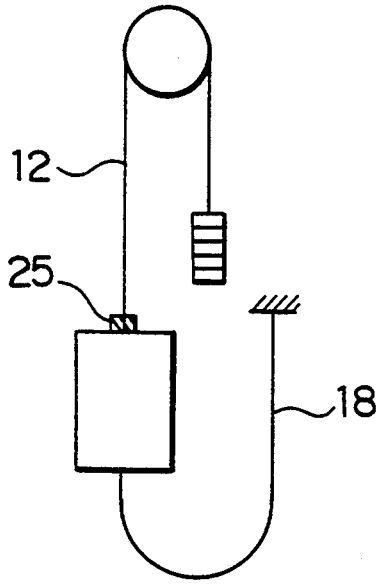
FIGS. 6A to 6C are schematic views of elevators in different kinds of roping manners.
Figure 6B:
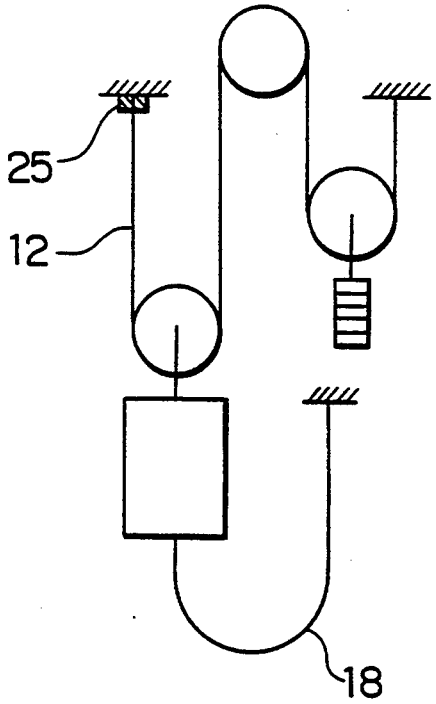
Figure 6C:
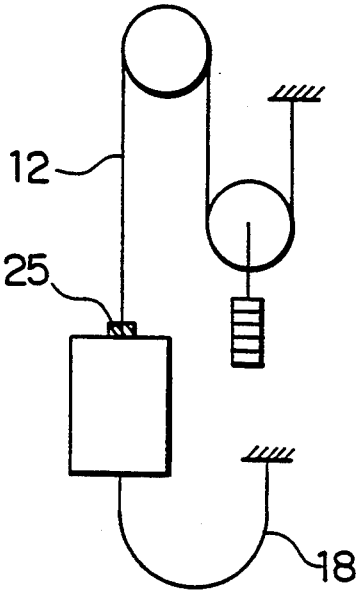

Although the one-to-one roping elevator shown in FIG. 3 is mentioned in the above second embodiment, the same weight detection can be performed even in an elevator in other roping manners besides the one-to-one roping. FIGS. 6A to 6C are schematic views of elevators using different roping arrangements.

FIGS. 6A, 6B and 6C show a one-to-one roping elevator, a two-to-one roping elevator, and an elevator using a special roping arrangement.

For example, even in the case of the two-to-one roping elevator shown in FIG. 6B, the weight can be detected in the same manner as in the one-to-one roping elevator.

However, in the case of the two-to-one roping elevator, the self-weight Wcar of the elevator car, that is the self-weight of the elevator car in the above one-to-one elevator, is changed to ($\frac{1}{2}$) Wcar, the rated load L is changed to ($\frac{1}{2}$)L, the weight wc(Z) of the cable detected by the weighing device 25 is changed to the weight wc(Z) of the rope and the cable detected by the load weighing device 25, and other conditions are the same. Specifically, the position Z of the elevator car, the unbalanced weight $\epsilon$ of the cable 18 included in the counterweight 13, the weight wr(Z) of the rope and cable detected by the motor 19, the weighed value V (Z, $\gamma$) when the car position is Z and the load rate is $\gamma$, the constant ZB showing that the elevator car is at the bottom floor 24, the constant ZC showing that the elevator car is at the center floor 23, the constant ZT showing that the elevator car is at the top floor 22, the first assumption and the second assumption, are similarly used.

As a result, a control weighed value and a drive weighed value are detected in the two-to-one roping elevator in the same manner as in the one-to-one roping elevator.

Besides the above one-to-one and two-to-one roping elevators, a control weighed value and a drive weighed value are similarly detected in the elevator in a special roping manner shown in FIG. 6C.

As described above, the elevator control apparatus in the second embodiment, it is possible to precisely detect the load-in-car, that is, the weight of passengers in the elevator car by the load-in-car detection means 1A. The detection is a function of a control weighing device. Thereby, it is possible to detect the excess of passengers in the elevator car and inform to the passengers that there are too many passengers. It is also possible not to respond to calls from passengers waiting on landing floors (pass some of the landing floors) so that additional passengers cannot get into the elevator car when the elevator car is full. Furthermore, it is possible to properly assign a plurality of group-controlled elevators. In other words, the detection is extremely important in safety and operational efficiency of the elevator. It is natural that safety and the operational efficiency are improved as the detection accuracy is enhanced.

Since the elevator control apparatus in this embodiment is provided with the sheave load detection means 1*b* for detecting the load on the side of the sheave in addition to the load-in-car detection means 1A, it is possible to precisely detect the load on the side of the sheave, which corresponds to a difference in weight between the side of the elevator and the side of the counterweight with respect to the sheave. This detection is a function of the drive weighing device. Thereby, it is possible to generate a torque for compensating for the unbalanced weight in the motor previous to the drive of the motor so as to avoid the shock when the elevator starts to move. The landing accuracy can be also improved.

As described above, the load detection means 1 in the elevator control apparatus is composed of the load-in-car detection means 1A functioning as a control weighing device and the sheave load detection device 1B functioning as a drive weighing device. The control weighing device and the drive weighing device have different functions, but both devices are essential to the detection of the load in the elevator. The calculation by the devices are performed based on the signal 25*a* from the weighing device 25. If the conventional weighing device 17 of the analog output method disposed under the elevator car can ignore the unbalanced load in the elevator car, the output 17*a* from the weighing device 17 can be used as a control weighed value without being corrected. However, if the weighing device 17 cannot ignore the unbalanced load in the elevator car, it is preferable to dispose the weighing device 25 on the elevator car 10 as shown in FIG. 3.

As described above, in the second embodiment, both the load-in-car corresponding to the weight in the elevator car and the load on the side of the sheave (the weight of the rope 12 and the cable 18), that is, the weight on the side of the sheave corresponding to the unbalanced torque with respect to the sheave can be detected successively and precisely. The weight on the side of the sheave, that is, the weight of the car frame 14, the rope 12 and the cable 18 can be detected. By compensating the detected value in accordance with the position of the elevator car, the weight of power lines and signals lines connected to the elevator car and contained in the rope 12 and the cable 18 is always considered, and the unbalanced weight is properly reflected in the motor torque command. As a result, the riding quality, landing quality and landing accuracy is improved.

Still furthermore, since the weighing device 25 is mounted on the elevator car, it can precisely detect the total weight of the car frame 14, the cage 15, the passengers and loads in the elevator car, the cable and so on even if there is an unbalanced load on the floor of the elevator car. Since the weighing device 25 detects only the displacement of a rope shackle spring, production cost is low.

In addition, since it is unnecessary for the designer to adjust the zero point and gain of the weighing device 25 by calculation when an apparatus is shipped, production efficiency is extremely high.

What is claimed is:

1. An apparatus for determining drive torque for an elevator car motor in an elevator system including a weight, an elevator car, a pulley and a rope disposed around the pulley and interconnecting the weight and the elevator car, the apparatus comprising:

means for driving said elevator car through a drive path, the elevator car being driven at a constant speed throughout at least a part of the drive path;

torque command generating means for generating a torque command based on the difference of a motor speed command signal and the actual motor speed signal;

converter means for supplying electric power to a motor for driving an elevator car;

car position calculation means for calculating the present position X of said elevator car;

means for calculating a torque difference command $\Delta T_0$ between torque measured at a first position $X_1$ and torque measured at a second position $X_3$;

distance calculating means for calculating the distance between the first position $X_1$ and the second position $X_3$ and for calculating a length of the elevator drive path $X_4$;

compensation means for calculating a compensation value $\Delta T$ for compensating for the difference in weights of rope and cable positioned between the weight and the pulley and rope and cable positioned between the elevator car and the pulley according to the following equation:

$$\Delta T = \Delta T_0 (X_4/(X_3 - X_1));$$

load weighing means for detecting a load $T_2$ in said elevator car;

and final torque command supply means for adding outputs of said compensation means and said load weighing means to the torque command generated by said torque command generating means and supplying the torque command as a final torque command to said converter means.

2. An elevator control apparatus as claimed in claim 1 wherein said car position calculation means includes a speed detector connected to said car motor and a calculator for calculating the position of the said elevator car based on the speed of said motor detected by said speed detector.

3. An elevator control apparatus as claimed in claim 1 wherein said load weighing means is disposed at the bottom of said elevator car.

4. An elevator control apparatus as claimed in claim 1 wherein said final torque command supply means is an adder.

5. An apparatus as claimed in claim 1 wherein the first position $X_1$ and the second position $X_3$ are positions traversed by the elevator car when the elevator car is driven through the drive path at a constant speed.

6. An apparatus as claimed in claim 5 wherein the position $X_1$ is a position where the elevator car ceases to accelerate.

7. An apparatus as claimed in claim 5 wherein the position $X_3$ is a position where the elevator car begins to decelerate.

* * * * *

UNITED STATES PATENT AND TRADEMARK OFFICE

CERTIFICATE OF CORRECTION

PATENT NO. : 5,441,127

DATED : August 15, 1995

INVENTOR(S) : Ikejima et al.

It is certified that error appears in the above-indentified patent and that said Letters Patent is hereby corrected as shown below:

Column 12, Line 62, after "car" insert --drive--;

Line 63, after "of" delete --the--.

Signed and Sealed this

Twenty-third Day of April, 1996

Bruce Lehman

*Attest:*

BRUCE LEHMAN

*Attesting Officer*

*Commissioner of Patents and Trademarks*